US009468260B2

(12) United States Patent
Anderson

(10) Patent No.: US 9,468,260 B2
(45) Date of Patent: Oct. 18, 2016

(54) FOOTWEAR WITH EXTERNAL HEEL COUNTER

(71) Applicant: Jordan Anderson, Lancaster, OH (US)

(72) Inventor: Jordan Anderson, Lancaster, OH (US)

(73) Assignee: Rocky Brands, Inc., Nelsonville, OH (US)

( * ) Notice: Subject to any disclaimer, the term of this patent is extended or adjusted under 35 U.S.C. 154(b) by 350 days.

(21) Appl. No.: 14/041,091

(22) Filed: Sep. 30, 2013

(65) Prior Publication Data

US 2014/0130380 A1 May 15, 2014

Related U.S. Application Data

(63) Continuation-in-part of application No. 29/436,845, filed on Nov. 9, 2012, now Pat. No. Des. 690,498.

(51) Int. Cl.

| | |
|---|---|
| ***A43B 23/17*** | (2006.01) |
| ***A43B 23/08*** | (2006.01) |
| ***A43B 23/14*** | (2006.01) |
| ***A43B 23/16*** | (2006.01) |

(52) U.S. Cl.

CPC ..... *A43B 23/088* (2013.01); *A43B 23/14* (2013.01); *A43B 23/16* (2013.01); *A43B 23/17* (2013.01)

(58) Field of Classification Search

CPC .... A43B 23/14; A43B 23/17; A43B 23/088; A43B 23/16

USPC ..... 36/68

See application file for complete search history.

(56) References Cited

U.S. PATENT DOCUMENTS

| | | | | | |
|---|---|---|---|---|---|
| 2,301,836 | A | * | 11/1942 | Wilcox | A43B 3/14 12/146 D |
| 2,421,604 | A | * | 6/1947 | Eaton | A43B 23/14 12/146 R |
| 3,217,345 | A | * | 11/1965 | Suitzer | A43B 9/02 12/142 R |
| 4,622,764 | A | * | 11/1986 | Boulier | A43B 23/17 36/68 |
| 5,611,156 | A | * | 3/1997 | Chiu | A43B 1/0036 36/100 |

* cited by examiner

*Primary Examiner* — Ted Kavanaugh

(74) *Attorney, Agent, or Firm* — Porter, Wright, Morris & Arthur, LLP

(57) ABSTRACT

Footwear includes a sole, an upper secured to the sole for covering a foot of the wearer, and an external heel counter located at a rear of the upper and configured to be located behind a heel of the foot and to not extend along lateral sides of the heel. Portions of the upper adjacent the heel counter comprise leather and the heel counter comprises molded rubber. Lateral sides of the heel counter are arcuate and concave and an external surface of the heel counter is provided with raised ridges. Some of the leather portions of the upper adjacent the rubber heel counter are stitched to and over the rubber heel counter and some of the leather portions of the upper adjacent the rubber heel counter are stitched to and under the rubber heel counter.

20 Claims, 5 Drawing Sheets

FOOTWEAR WITH EXTERNAL HEEL COUNTER

CROSS-REFERENCE TO RELATED APPLICATIONS

This application is a continuation-in-part (CIP) of patent application Ser. No. 29/436,845 filed on Nov. 9, 2012 now U.S. Pat. No. D690,498 issued on Oct. 1, 2013, the disclosure of which is expressly incorporated herein in its entirety by reference.

STATEMENT REGARDING FEDERALLY SPONSORED RESEARCH

Not Applicable

PARTIES TO JOINT RESEARCH AGREEMENT

Not Applicable

REFERENCE TO APPENDIX

Not Applicable

FIELD OF THE INVENTION

The field of the present invention generally relates to footwear and, more particularly, to footwear having a heel counter.

BACKGROUND OF THE INVENTION

Shoes and boots often have a heel counter that used to stiffen the material around the heel and to give support to the foot. The heel counter can be a piece of leather forming the back of the shoe or boot but more often the heel counter is placed on the inside of the shoe or boot between the lining and the leather outsole. The heel counter is typically shaped to extend around the heel to hold the heel in place and provide stability so that it does not shift or slip. A high counter sometimes aids in keeping the foot from rolling over the side of the shoe or boot.

While heel counters are intended to provide rigidity, they often are too rigid which can irritate or injure the wearer's heel. Accordingly, there is a need for improved footwear with heel counters.

SUMMARY OF THE INVENTION

Disclosed are footwear that overcome at least one of the disadvantages of the prior art described above. Disclosed is footwear comprising, in combination, a sole, an upper secured to the sole for covering a foot of the wearer, and an external heel counter located at a rear of the upper and configured to be located behind a heel of the foot and to not extend along lateral sides of the heel.

Also disclosed is footwear comprising, in combination, a sole, an upper secured to the sole for covering a foot of the wearer, and an external heel counter located at a rear of the upper and configured to be located behind a heel of the foot. The heel counter comprises rubber.

Also disclosed is footwear comprising, in combination, a sole, an upper secured to the sole for covering a foot of the wearer; and an external heel counter located at a rear of the upper and configured to be located behind a heel of the foot and to not extend along lateral sides of the heel. Lateral sides of the heel counter are arcuate and concave. Some portions of the upper adjacent the heel counter are stitched over the heel counter and some of the portions of the upper adjacent the heel counter are stitched under the heel counter.

From the foregoing disclosure and the following more detailed description of various preferred embodiments it will be apparent to those skilled in the art that the present invention provides a significant advance in the technology and art of footwear. Particularly significant in this regard is the potential the invention affords footwear with heel counters providing improved performance. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
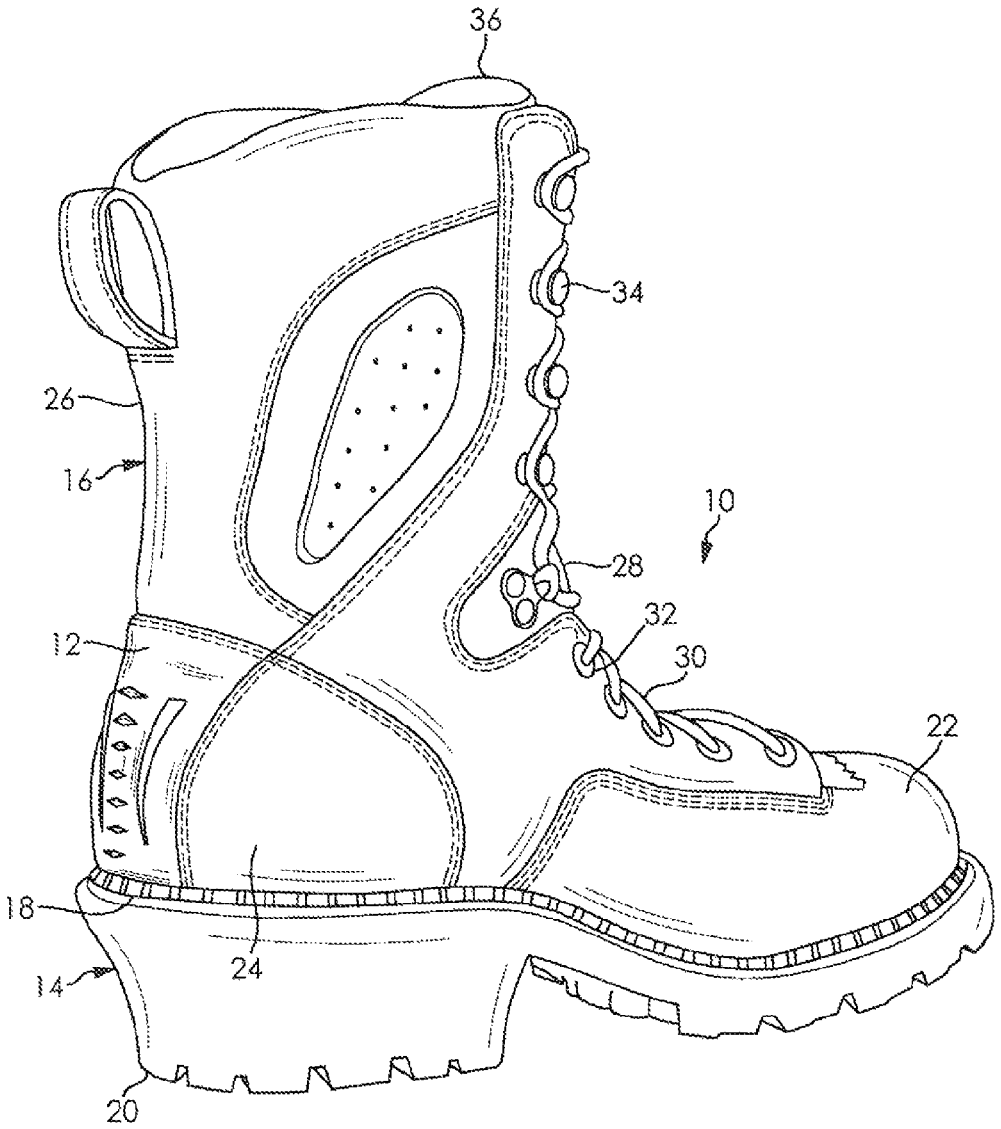
FIG. 1 is a rear perspective view of footwear having an external heel counter according to the present invention.
Figure 2:
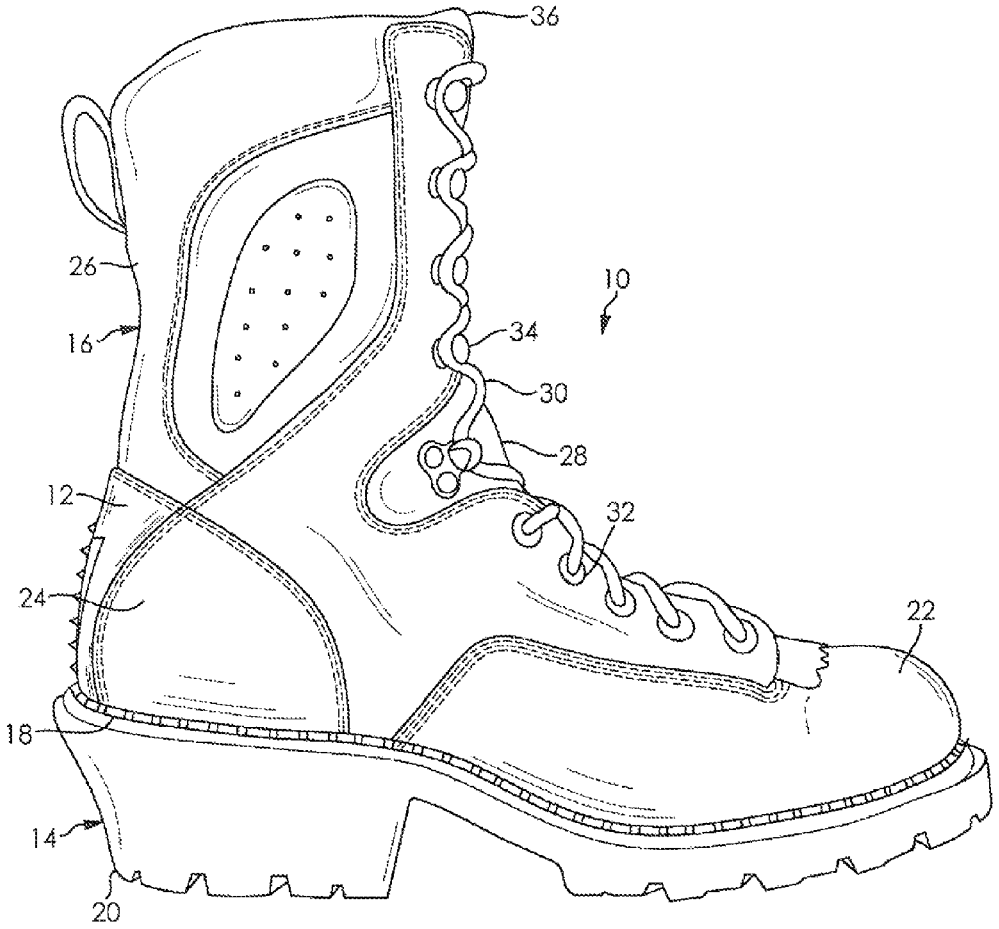
FIG. 2 is a right side elevational view of the footwear of FIG. 1.
Figure 3:
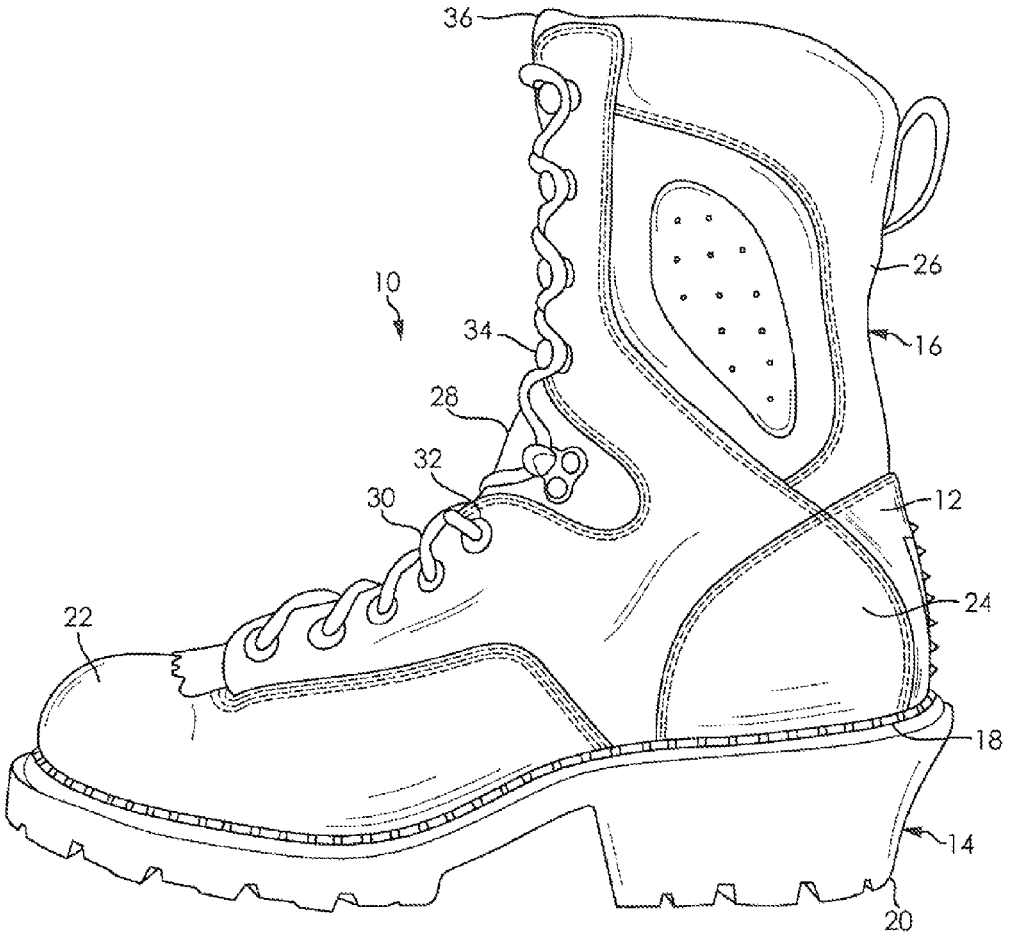
FIG. 3 is a left side elevational view of the footwear of FIGS. 1 and 2.
Figure 4:
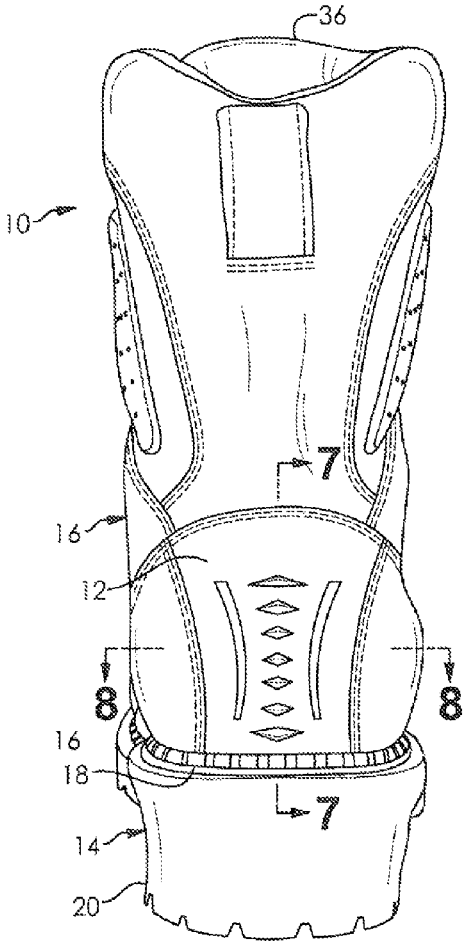
FIG. 4 is a rear elevational view of the footwear of FIGS. 1 to 3.

It should be understood that the appended drawings are not necessarily to scale, presenting a somewhat simplified representation of various preferred features illustrative of the basic principles of the invention. The specific design features of the footwear as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the footwear illustrated in the drawings. In general, up or upward generally refers to an upward direction within the plane of the paper in FIG. 2 and down or downward generally refers to a downward direction within the plane of the paper in FIG. 2. Also in general, front or forward generally refers to a direction toward the right within the plane of the paper in FIG. 2 and rear or rearward generally refers to a direction toward the left within the plain of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the footwear disclosed herein. The following detailed discussion of various alternative and preferred embodiments will illustrate the general principles of the invention with regard to a work boot. Other embodiments of the present invention suitable for other applications will be apparent to those skilled in the art given the benefit of this disclosure. For example, the present invention is suitable for other types of footwear such as, for example, western boots, outdoor boots, duty or military boots, shoes, and the like.

Referring now to the drawings, FIGS. 1 to 4 show footwear in the form of a work boot 10 having an external heel counter 12 according to the present invention. The illustrated boot 10 is adapted for use on a right foot but it is noted that a similar but mirror image boot adapted for the left foot is used in conjunction with the illustrated boot 10 for form a pair of the boots 10. The illustrated boot 10 includes a sole 14 forming the bottom of the boot 10 and extending below the boot wearer's foot and an upper 16 extending upward from the sole 14 to cover the boot wearer's foot and a small portion of their lower leg.

The illustrated upper 16 is secured to the sole 14 with a welted construction where the upper 16 is stitched to the sole 14 using a welt 18. The welt 18 is a strip of leather or synthetic material which extends about the periphery of the upper 16 at the interface between the upper 16 and the heel counter 12 with the sole 14. The upper 16 and the heel counter 12 are stitched to the welt 18 with thread and the welt 18 is in turn stitched to the sole 14 with thread to secure the upper 16 and the heel counter 12 to the sole 14. It is noted that upper 16 and/or the heel counter 12 can alternatively be secured to the sole 14 using any other suitable construction such as, for example, a cemented construction where the upper 16 and/or heel counter is glued to the sole 14 with adhesive, or the like.

The illustrated outsole 14 includes an outsole 20 forming an exterior bottom surface for the sole 14 and an insole (not visible) located above the outsole 20 and forming an upper interior surface of the sole 14 upon which the boot wearer's foot rests within the upper 16. It is noted that the sole 14 can also include a midsole located between the outsole 20 and the insole and/or a shank forming an arch support within the sole 14. The outsole 20 is the outermost portion of the sole 14 of the boot 10 and forms the bottom surface of which is exposed to wear. The illustrated bottom surface of the outsole 20 is provided with tread. The illustrated outsole 20 is molded of synthetic polymer material but can alternatively can comprise any other suitable material such as, for example, rubber, leather or the like. The insole can be attached to the outsole 20, the midsole, the upper 16, and/or welt 18 or the insole can be removable and/or replaceable. The insole can form the upper most surface on the inside of the bottom of the boot or it can be covered with a sock lining of suitable material. The midsole can be located between the outsole 20 and the insole. The midsole can be molded of synthetic polymer material but can alternatively can comprise any other suitable material. The midsole is designed to provide the boot 10 with desired characteristics of cushioning, support, and flexibility. The shank can form the arch support which supports the arch of the boot wearer's food and can comprise steel, fiber, wood, and/or plastic. It is noted that the sole 14 can alternatively have any other suitable construction within the scope of the present invention.

The illustrated upper 16 includes a vamp 22 which covers the top and front portion of the boot wearer's foot, a counter or quarter 24 that encloses the heel or rear portion of the boot wearer's foot and is secured to the rear of the vamp 22, and a shaft 26 which fits around the lower leg of the boot wearer's leg and is secured to the top of the vamp 22 and the quarter 24. The shaft 26 has an upper edge which forms an upper opening through which the wearer's foot enters the boot 10. The illustrated vamp 22 and the shaft 26 cooperate to form an opening 28 at the forward end of the boot 10 that is closed by a lace 30 so that the opening 28 can be tightened to secure the boot 10 to the wearer's foot and loosened to ease entry and exit of the wearer's foot. The illustrated vamp 22 and the shaft 26 are provided with a plurality of eyelets 32 and hooks 34 for the lace 30 as is known in the art. A tongue 36 is also provided at the laced opening as is also known in the art. It is noted that the upper 16 can also comprise a lining within its interior. The lining typically comprises pigskin, glove leathers, a heavy twilled cotton or linen fabric, and the like. Additionally, the lining can comprise synthetics such as, for example, Gortex, Sympatex, and the like to provide waterproof and/or sweat dissipating characteristics to the boot 10. It is noted that the upper 16 can alternatively have any other suitable configuration.

The illustrated components of the upper 18 comprise leather such as, for example, cowhide, pigskin, horsehide, kangaroo skin, and the like but any other suitable material can alternatively be utilized such as, for example exotic leathers or skins, synthetic leather or other synthetic materials, cloth, and the like. The illustrated components of the upper 18 are secured together by stitching but any other suitable means can alternatively be utilized.

The illustrated heel counter 12 is an external heel counter. That is, the heel counter 12 forms a portion of the exterior surface of the boot 10. The illustrated heel counter 12 is located at a rear of the upper 16 and is configured to be located behind a heel of the boot wearer's foot and to not extend along lateral sides of the heel of the boot wearer's foot.

Figure 5:
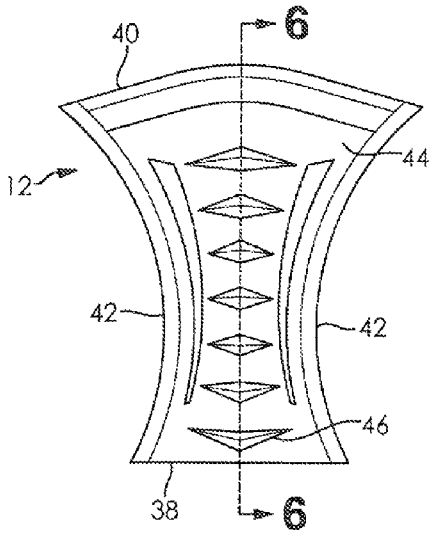
FIG. 5 is a rear elevational view of the external heel counter of the footwear of FIGS. 1 to 4.
Figure 6:
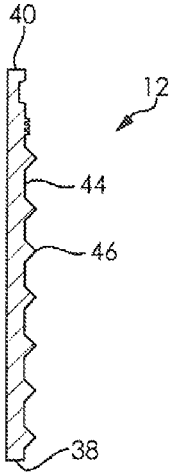
FIG. 6 is cross section view taken along line 6-6 of FIG. 5.

As best shown in FIGS. 5 and 6, the illustrated heel counter 12 is generally hour class shape. The illustrated heel counter 12 has a substantially straight bottom edge 38, an arcuate and convex top edge 40 opposite the bottom edge 38, and opposed arcuate and concave lateral side edges 42 connecting the bottom and top edges 38, 40. The concave lateral sides 42 provide some flexibility to the rigid heel counter 12. It is noted that the illustrated top edge 40 has a lateral width larger than the later width of the illustrated bottom edge 38 so that the heel counter 12 does not extend along lateral sides of the heel of the boot wearer's foot but partially extends along lateral sides of the boot 10 above heel of the boot wearer's foot. Configured in this manner, an upper portion of the illustrated heel counter 12 extends forwardly above the heel of boot wearer's foot (best shown in FIGS. 2 and 3) to lock the heel of boot wearer's foot in place. The illustrated hour glass shape is effective to lock the top of the ball of the boot wearer's heel and the bottom but allows the center to be more flexible. It is noted that the heel counter 12 can alternatively have any other suitable shape.

The illustrated heel counter 12 is formed of a material more rigid than the material forming the portions of the upper 16 adjacent the heel counter 12. The heel counter 12 preferably comprises a polymeric material, more preferably comprises rubber, and even more preferably comprises molded rubber. It is noted that rubber has great abrasion resistant properties, holds its shape well without being too rigid or hard on the boot wearer's heel. It is noted however, that the heel counter 12 can alternatively comprise any other suitable material and/or can be formed in any other suitable manner. The illustrated heel counter 12 is molded such that an external surface 44 of the heel counter 12 is provided with a plurality raised ridges 46. The illustrated ridges 46 laterally extend and are vertically spaced-apart one above the other.

Figure 8:
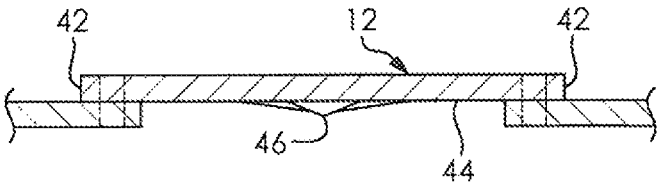
FIG. 8 is cross section view taken along line 8-8 of FIG. 4.

The illustrated ridges 46 are triangular shaped in a vertical cross-section to form a sharp rear outer edge (best shown in FIG. 6). The illustrated ridges 46 are also triangular shaped in a horizontal cross-section to form a sharp rear outer edge (best shown in FIG. 8). Configured in this manner, the ridges 46 operate to reduce scuffing of the external rear surface 44 of the heel counter 12 which often occurs when removing boots.

Figure 7:
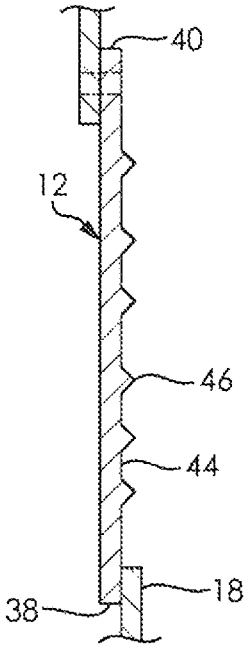
FIG. 7 is cross section view taken along line 7-7 of FIG. 4.

The illustrated external heel counter 12 is located at the rear of the upper 16 with the bottom edge 38 secured to the sole 14 via the welt 18 via stitching with threads and the top and lateral side edges 40, 42 are secured to adjacent portions of the upper 16 via stitching with threads. The illustrated top edge 40 is secured to an adjacent portion of the shaft 26 while the illustrated side edges 42 are secured to adjacent portions of the quarter 24. In the illustrated embodiment, some of the portions of the upper 16 adjacent the heel counter 12 are stitched over the heel counter 12 and some of the portions of the upper 16 adjacent the heel counter 12 are stitched under the heel counter 12. The illustrated top edge 40 is secured over the adjacent portion of the shaft 26 (best shown in FIG. 7) while the illustrated side edges 42 are secured under the adjacent portions of the quarter 24 (best shown in FIG. 8). That is, the illustrated the adjacent portion of the shaft 26 is secured under the top edge 40 (best shown in FIG. 7) while the illustrated the adjacent portions of the quarter 24 are secured over side edges 42 (best shown in FIG. 8). It is noted that the configuration of the upper 16 and/or the configuration of the connections between the upper 16 and the heel counter 12 can be in any other suitable manner.

Any of the features or attributes of the above the above described embodiments and variations can be used in combination with any of the other features and attributes of the above described embodiments and variations as desired.

It is apparent from the forgoing disclosure and detailed description that the present invention provides a heel counters that are stiff, rigid, semi-protective, and support the boot wearer's heel to not shift or slip.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. Footwear comprising, in combination:

a sole;

an upper secured to the sole for covering a foot of the footwear wearer; and an external heel counter located at a rear of the upper and configured to be located behind a heel of the foot and forms a portion of an exterior surface of the footwear;

wherein the heel counter comprises a polymeric material;

wherein portions of the upper located laterally adjacent to the heel counter comprise leather;

wherein the heel counter has a generally hour glass shape including a substantially straight bottom, an arcuate and convex top, and opposed arcuate and concave lateral sides each connecting the bottom and the top; and wherein a lateral width of the top is larger than a lateral width of the bottom so that the top of the heel counter partially extends along lateral sides of the footwear but the bottom of the heel counter does not extend along the lateral sides of the footwear.

2. The footwear according to claim 1, wherein the heel counter comprises rubber.

3. The footwear according to claim 2, wherein the heel counter comprises molded rubber.

4. The footwear according to claim 1, wherein the portions of the upper adjacent the heel counter are stitched over and to the lateral sides of the heel counter and a portion of the upper located adjacent to and above the top of the heel counter is stitched under and to the top of the heel counter.

5. The footwear according to claim 1, wherein the heel counter is more rigid than the portions of the upper adjacent the heel counter.

6. The footwear according to claim 1, wherein an external surface of the heel counter is provided with raised ridges.

7. The footwear according to claim 6, wherein the raised ridges are triangular shaped in a vertical cross section and are triangular shaped in a horizontal cross section.

8. The footwear according to claim 4, wherein the portion of the upper located adjacent to and above the top of the heel counter comprises leather.

9. Footwear comprising, in combination:

a sole;

an upper secured to the sole for covering a foot of the footwear wearer;

an external heel counter located at a rear of the upper and configured to be located behind a heel of the foot and forms a portion of an exterior surface of the footwear;

wherein the heel counter comprises a polymeric material;

wherein portions of the upper located laterally adjacent to the heel counter comprise leather; and wherein at least the portions of the upper located laterally adjacent to the heel counter are stitched over and to lateral sides of the heel counter.

10. The footwear according to claim 9, wherein the heel counter comprises rubber.

11. The footwear according to claim 10, wherein the heel counter comprises molded rubber.

12. The footwear according to claim 9, wherein the portion of the upper located adjacent to and above the heel counter is stitched under and to a top of the heel counter.

13. The footwear according to claim 9, wherein the heel counter is more rigid than the portions of the upper adjacent the heel counter.

14. The footwear according to claim 9, wherein the heel counter has a generally hour glass shape including a substantially straight bottom, an arcuate and convex top, and the opposed lateral sides which are each arcuate and concave and connecting the bottom and the top.

15. The footwear according to claim 14, wherein a lateral width of the top is larger than a lateral width of the bottom so that the top of the heel counter partially extends along lateral sides of the footwear but the bottom of the heel counter does not extend along the lateral sides of the footwear.

16. The footwear according to claim 9, wherein an external surface of the heel counter is provided with raised ridges.

17. The footwear according to claim 16, wherein the raised ridges are triangular shaped in a vertical cross section and are triangular shaped in a horizontal cross section.

18. A boot comprising, in combination:

a sole;

an upper secured to the sole for covering a foot of the boot wearer;

an external heel counter located at a rear of the upper and configured to be located behind a heel of the foot and forms a portion of an exterior surface of the footwear;

wherein the heel counter comprises a polymeric material;

wherein portions of the upper located laterally adjacent to the heel counter each comprise leather and a portion of the upper located adjacent to and above the heel counter comprises leather;

wherein the heel counter has a generally hour glass shape including a substantially straight bottom, an arcuate and convex top, and opposed arcuate and concave lateral sides each connecting the bottom and the top;

wherein a lateral width of the top of the heel counter is larger than a lateral width of the bottom of the heel counter; and wherein the portions of the upper located laterally adjacent to the heel counter are stitched over and to the lateral sides of the heel counter and the portion of the upper located adjacent to and above the heel counter is stitched under and to the top of the heel counter.

19. The boot according to claim 18, wherein the heel counter comprises rubber.

20. The boot according to claim 19, wherein the heel counter comprises molded rubber and an external surface of the heel counter is provided with raised ridges.

* * * * *